United States Patent [19]

Kenichi

[11] Patent Number: 4,576,128

[45] Date of Patent: Mar. 18, 1986

[54] VALVE OPERATION STOPPING MEANS FOR MULTI-CYLINDER ENGINE

[75] Inventor: Kenichi Nagahiro, Saitama, Japan

[73] Assignee: Honda Giken Kogyo Kabushiki Kaisha, Tokyo, Japan

[21] Appl. No.: 682,424

[22] Filed: Dec. 17, 1984

[30] Foreign Application Priority Data

Dec. 17, 1983 [JP] Japan ..... 58-238424

[51] Int. Cl.[4] ..... F02D 13/06

[52] U.S. Cl. ..... 123/198 F; 123/90.16; 123/90.27; 123/90.39

[58] Field of Search ..... 123/198 F, 90.39, 90.15, 123/90.16, 90.27, 90.32

[56] References Cited

U.S. PATENT DOCUMENTS

| | | | |
|---|---|---|---|
| 4,203,397 | 5/1980 | Soeters | 123/198 F |
| 4,204,512 | 5/1980 | Brock Jr. | 123/198 F |
| 4,252,093 | 2/1981 | Hazelrigg | 123/90.39 |

FOREIGN PATENT DOCUMENTS

| | | | |
|---|---|---|---|
| 3148720 | 7/1983 | Fed. Rep. of Germany | 123/198 F |

*Primary Examiner*—Ira S. Lazarus

*Attorney, Agent, or Firm*—Lyon & Lyon

[57] ABSTRACT

A valve operation stopping mechanism for multi-cylinder internal combustion engine to cause selected cylinders to be inoperative under low load conditions for economy. A drive rocker arm is normally pivoted by a cam for each selected cylinder, a driven rocker arm is engaged with the suction or exhaust valve, a rocker shaft pivotably supports the drive rocker arm and the driven rocker arm so as to permit relative angular displacement, a synchro is provided in the driven rocker arm so as to slidably engage the drive rocker arm, and a timing piston is provided in the drive rocker arm opposite the synchro pin to control the position of the synchro pin by the action of hydraulic pressure. An arrangement of the timing pistons and hydraulic circuit causes the intake valve to always be rendered inoperative before the exhaust valve of a selected cylinder.

19 Claims, 11 Drawing Figures

VALVE OPERATION STOPPING MEANS FOR MULTI-CYLINDER ENGINE

This invention relates to a valve operation stopping means capable of selectively stopping the operation of the suction valve and exhaust valve of any one or more specific cylinders of a multi-cylinder internal combustion engine during low load operating conditions for fuel economy.

It is generally recognized that in a multi-cylinder internal combustion engine, if the valve opening and closing operation of the suction and exhaust valves in a specific cylinder of plural cylinders is stopped so as to substantially eliminate the work performed by that specific cylinder, the fuel consumption of the engine may be reduced during low load running operation of the engine. However, no completely satisfactory device for accomplishing this valve operation stopping function has been proposed for all valve mechanisms and in particular, for positive or forced valve operation mechanisms (desmodromic valve drive).

Several systems have been proposed wherein a hydraulic piston and cylinder are interposed in the valve lifting mechanism and by releasing the hydraulic fluid the valve operating stroke through the piston and cylinder is interrupted, such as in U.S. Pat. Nos. 1,985,447 and 4,050,435. In another system (U.S. Pat. No. 4,387,680) the mechanical valve lifter has reciprocating components that may be locked together for normal valve operation and the locking is accomplished by a hydraulic device.

Accordingly, it is an object of the present invention to provide a valve operation stopping device for a multi-cylinder internal combustion engine which may provide a highly reliable operation with a relatively simple construction and very practical use. To achieve this object, the present invention comprises a drive rocker arm normally rocked in association with a cam for a specific cylinder, a driven rocker arm engaged with a suction valve and an exhaust valve, a rocker shaft for pivotably supporting the drive rocker arm and the driven rocker arm so as to permit relative angular displacement of both the rocker arms, a synchro pin provided in the driven rocker arm so as to be slidably engaged with the drive rocker and a timing piston provided in the drive rocker arm at a position corresponding to the synchro pin and acting to urge the synchro pin to the driven rocker arm side by an action of hydraulic pressure to release connection between the drive rocker arm and the driven rocker arm.

Another object of this invention is to provide a valve operating mechanism of the type for positive or forced valve opening and closing (desmodromic valve drive), rather than spring biased for closing, wherein novel means are provided for valve operation stopping for one or more cylinders for economical operation during low load operation of the engine.

Still another object of this invention is to provide a novel and simple hydraulic operation system for the valve operation stopping mechanism and lubricating system for the entire valve operating mechanism.

Other and more detailed objects and advantages of this invention will appear to those skilled in the art from the following description of a preferred embodiment and the accompanying drawings wherein.

Figure 1:
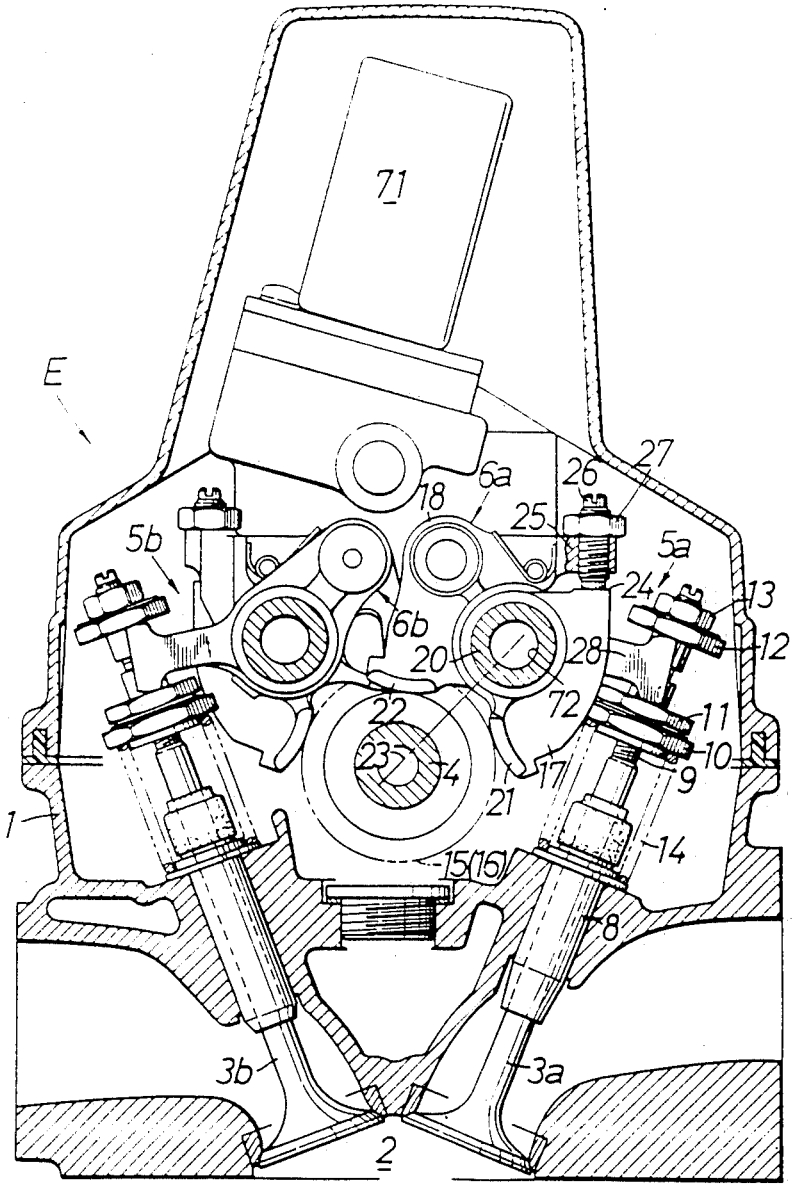
FIG. 1 is a vertical sectional view through the valve operating mechanism portion of an internal combustion engine incorporating the present invention.
Figure 2:
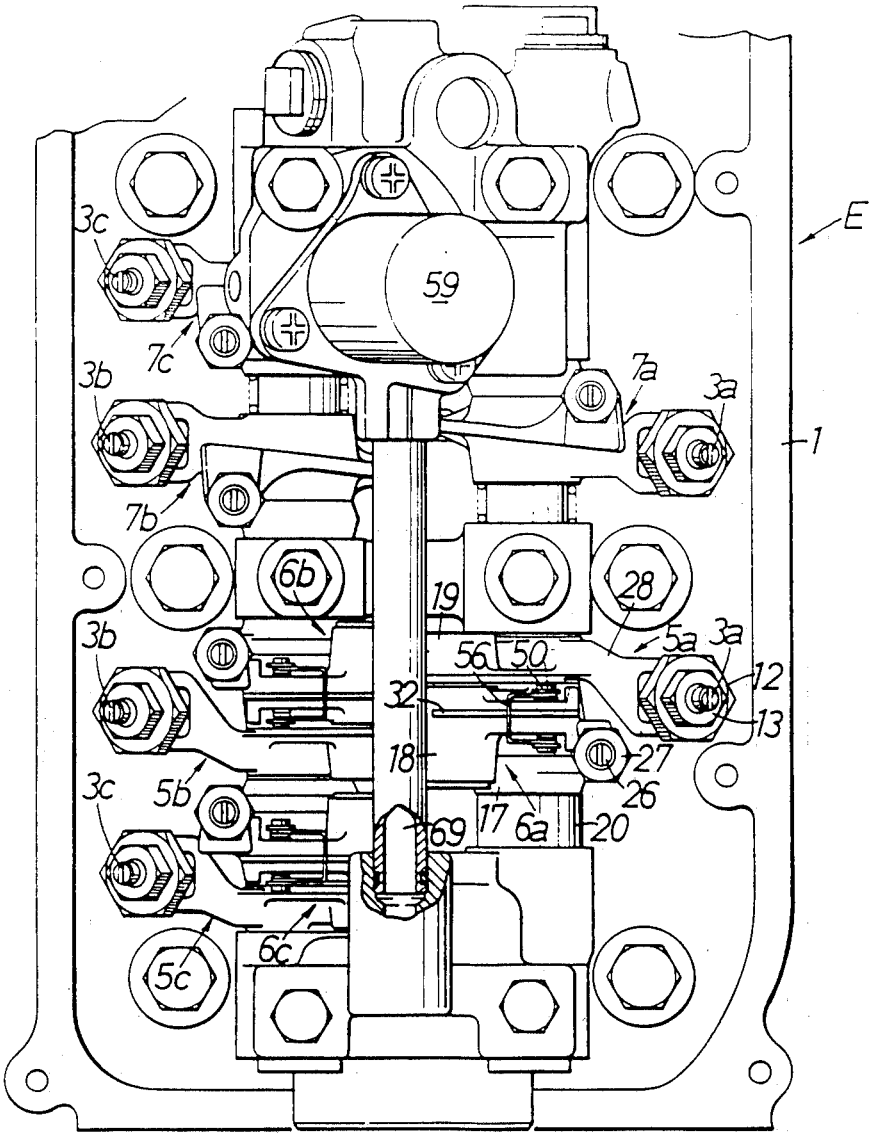
FIG. 2 is a plan view of the valve operating mechanism illustrated in FIG. 1.

Referring now to FIGS. 1 and 2, an internal combustion engine E is of the multi-cylinder type is shown with a cylinder head 1 in which each cylinder is provided with an intake or suction valve 3*a* for intaking air and fuel to the main combustion chamber 2 and an exhaust valve 3*b* for exhausting gas therefrom. The cylinder head may also be provided with a suction valve 3*c* for intaking air and fuel to an auxiliary combustion chamber (not shown) for engines of the type that incorporate same. Each of these valves 3*a*, 3*b* and 3*c* are operated to open and close by appropriate mechanisms.

The present invention will be described in connection with mechanisms for positive or forced valve operation (desmodromic valve drive) but it will be appreciated that many aspects of the present invention are also applicable to the more conventional valve mechanism employing springs for biasing the valves to the closed position. Although each of the valves 3*a*, 3*b* and 3*c* is forcibly opened and closed according to rotary operation of a cam shaft 4, some of the valves 3*a*, 3*b* and 3*c* of the cylinders are stopped from operating during a low load running of the engine. If the four cylinders are numbered for example, by the first to the fourth sequentially from one end to the other, each of the valves 3*a*, 3*b* and 3*c* of the first and fourth cylinders is forcibly operated by the positive forced valving mechanisms 5*a*, 5*b* and 5*c* corresponding to those respective valves during high load running conditions, but the operation is stopped by the function of the operation stopping mechanisms 6*a*, 6*b* and 6*c*, respectively, during low load running. On the other hand, each of the valves 3*a*, 3*b* and 3*c* of the second and third cylinders is always operated by the positive forced valving mechanisms 7*a*, 7*b* and 7*c*, respectively, corresponding to the valves regardless of the magnitude of the load.

The forced valving mechanisms 5*a*, 5*b* and 5*c* and the operation stopping mechanisms 6*a*, 6*b* and 6*c*, respectively, corresponding to the valves 3*a*, 3*b* and 3*c* of the first and fourth cylinders are identical in construction.

Similarly, the normally forced valving mechanisms 7*a*, 7*b* and 7*c* corresponding to the valves 3*a*, 3*b* and 3*c*, respectively, of the second and third cylinders are also identical in construction. Therefore, the following detailed description will refer to the forced valving mechanism 5*a*, the operation stopping mechanism 6*a*, the normally forced valving mechanism 7*a* and the associated parts thereof, while the detailed description relating to the other forced valving mechanisms 5*b* and 5*c*, the operation stopping mechanisms 6*b* and 6*c* and the normally forced valving mechanisms 7*b* and 7*c* will be omitted.

The suction valve 3*a* of the first cylinder is movably mounted in a guide sleeve 8 which in turn is fixedly mounted in a hole vertically bored through the cylinder head 1. The valve 3*a* is formed with a male screw 9 at an upper end thereof. A retainer 10 is screwed onto the male screw 9, and a lower lifter 11 is also screwed onto the male screw 9, and a lower lifter 11 is also screwed onto the male screw 9 with its downward movement restricted by the retainer 10. An upper lifter 12 is screwed onto the male screw 9 at a position upwardly spaced apart from the lower lifter 11 and upward movement of the upper lifter 12 is restricted by a lock nut 13 screwed onto the male screw 9 on the upper side of the upper lifter 12. The forced valving mechanism 5*a* has a component engaged between the lower lifter 11 and the upper lifter 12, whereby the rocking operation of the forced valving mechanism 5*a* causes a forced up-and-down motion, that is, a forced opening and closing operation of the suction valve 3*a*.

A coiled spring 14 surrounding the suction valve 3*a* is interposed between the upper surface of the cylinder head 1 and the retainer 10, whereby the suction valve 3*a* is biased by the spring force of the spring 14 in a valve closing direction. However, the spring force of the spring 14 is very small, only sufficient to retain the valve in the closed state, and it does not interfere with the opening and closing operation of the suction valve 3*a*.

Figure 3:
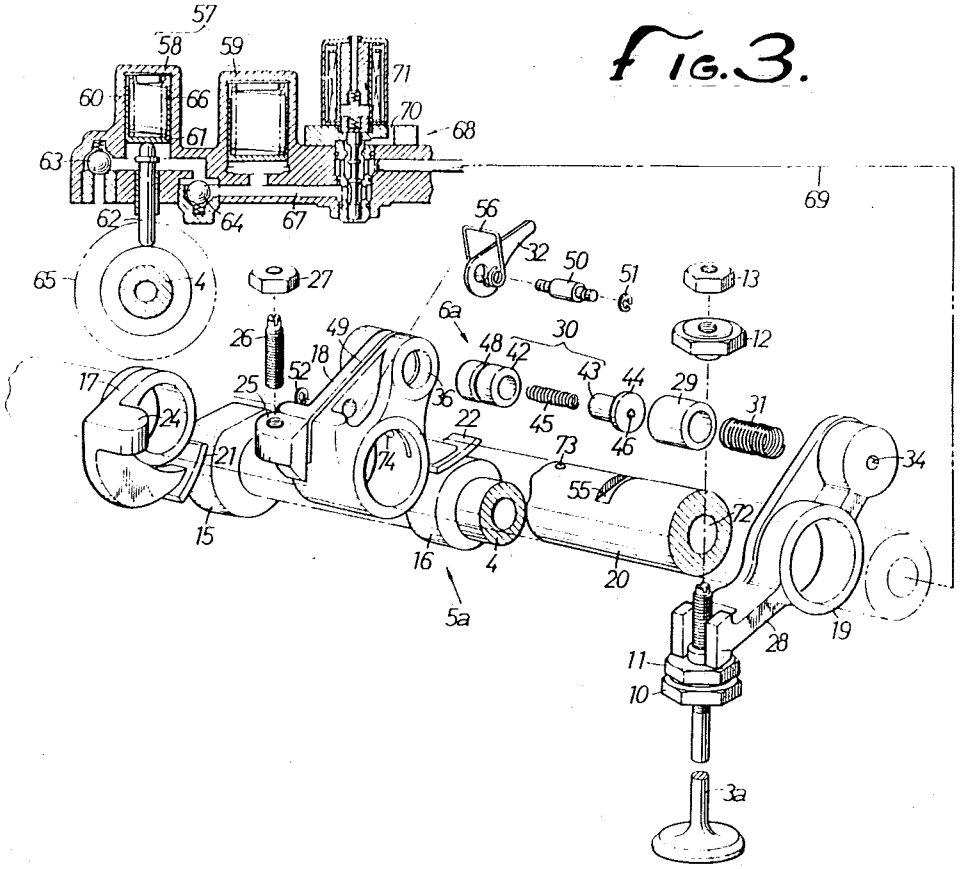
FIG. 3 is an exploded perspective view of the positive or forced valve operating mechanism with operation stopping means of this invention.

Referring to FIG. 3, the positive or forced valving mechanism 5*a* comprises a cam shaft 4 arranged at an upper central portion of the cylinder head 1 and is integrally provided with a valve closing cam 15 and a valve opening cam 16, a first rocker arm 17 in contact with the valve closing cam 15, a second rocker arm 18 as a drive rocker arm in contact with the valve opening cam 16 and being interlocked with the first rocker arm 17, a third rocker arm 19 comprising a driven rocker arm permitted to be connected to and released from the second rocker arm 18 and connected to the suction valve 3*a*, and a rocker shaft 20 arranged in parallel relation with the cam shaft 4 so as to pivotably support the rocker arms 17, 18 and 19.

The cam shaft 4 is rotatably supported at an upper portion of the cylinder head 1, and is rotated synchronously with rotation of the engine crankshaft in a rotational ratio of ½. The rocker shaft 20 is disposed above and to one side of the cam shaft 4 and is fixed to the upper portion of the cylinder head 1. The first rocker arm 17 is integrally provided with a cam slipper 21 for sliding contact with the valve closing cam 15. The second rocker arm 18 is integrally provided with a cam slipper 22 for sliding contact with the valve opening cam 16. The cam slippers 21 and 22 are arranged on opposite sides of a phantom straight line 23 connecting the centers of the cam shaft 4 and the rocker shaft 20. In other words, the cam slipper 21 of the first rocker arm 17 is in contact with the valve closing cam 15 on the suction valve side with respect to the phantom straight line 23, while the cam slipper 22 of the second rocker arm 18 is in contact with the valve opening cam 16 on the opposite side of the suction valve 3a with respect to the phantom straight line 23. Further, the first rocker arm 17 is provided with an abutment seat 24 directed upwardly at its upper portion on the suction valve side, and the second rocker arm 18 is integrally formed with a support portion 25 extending over the abutment seat 24. A tappet screw 26 abutting against the abutment seat 24 is axially screwed into the support portion 25, and a lock nut 27 is screwed onto the tappet screw 26 for preventing the tappet screw 26 from becoming inadvertantly loosened. Thus, the first and second rocker arms 17 and 18 are interlocked with each other by the tappet screw 26. In other words, when the first rocker arm 17 is rotated counterclockwise in FIG. 1 by the valve closing cam 15 it causes like counterclockwise rotation of second rocker arm 18, and when the second rocker arm 18 is rotated clockwise in FIG. 1 by the valve opening cam 16, the first rocker arm 17 is also rotated clockwise.

The third rocker arm 19 is integrally formed with an engagement arm 28 extending to the suction valve 3*a* and forked into two branches at an end portion thereof to be positioned on both sides of the valve stem 9. The end portion of the engagement arm 28 is engaged between the lower lifter 11 and the upper lifter 12 in such a manner as to confine the suction valve 3*a* in both directions of movement thereof. Accordingly, when the second rocker arm 18 and the third rocker arm 19 are in connection with each other, rotary movement of the first rocker arm 17 in a valve closing direction is transmitted through the second rocker arm 18 to the third rocker arm 19 and, as a result, the engagement arm 28 is upwardly rotated to urge the upper lifter 12 upwardly and thereby close the suction valve 3*a*. When the second rocker arm 18 is rotated in a valve opening direction, the third rocker arm 19 is simultaneously rotated to urge the lower lifter 11 downwardly by the engagement arm 28 and thereby to open the suction valve 3*a*.

The operation stopping mechanism 6*a* for carrying out a connecting and releasing operation between the second rocker arm 18 and the third rocker arm 19 is interposed between the second and third rocker arms 18 and 19. When the operation stopping mechanism 6*a* is operated, the connection between the second and third rocker arms 18 and 19 is released. Under such a released condition, operations of the first and second rocker arms 17 and 18 are not transmitted to the third rocker arm 19, and the suction valve 3*a* remains closed by the spring force of the spring 14.

Figure 4:
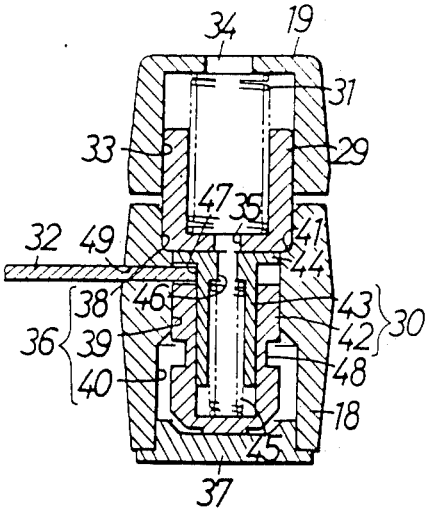
FIG. 4 is an enlarged sectional view of a portion of the valve operation stopping mechanism of this invention shown in FIGS. 1–3.

Referring to FIG. 4 in combination with FIG. 3, the operation stopping mechanism 6*a* comprises a synchro pin 29 movable along an axis parallel to the axis of the rocker shaft 20 between a first position where the second and third rocker arms 18 and 19 are connected with each other and a second position where the connection between the rocker arms 18 and 19 is released, a timing piston 30 for urging the synchro pin 29 to the connection released position by hydraulic pressure, a spring 31 for biasing the synchro pin 29 to its connected position, and a trigger plate 32 for restricting operation of the timing piston 30.

The third rocker arm 19 is formed with a guide hole 33 opened toward the second rocker arm 18 side and extending in parallel relation with the axis of the rocker shaft 20. The guide hole 33 is formed with an air vent hole 34 at the other side portion thereof. The synchro pin 29 includes a through hole 35 at a bottom portion thereof and is formed in a cup-like shape. The open end of the synchro pin 29 is directed to the air vent hole 34 of the third rocker arm 19 and is slidably fitted in the guide hole 33. A spring 31 is interposed between the bottom portion of the guide hole 33 and the synchro pin 29. Accordingly, the synchro pin 29 is biased by the spring force of the spring 31 in a direction such as to be projected from the guide hole 33, that is, toward the second rocker arm 18 side.

The second arm 18 is formed with a cylinder hole 36 corresponding to the guide hole 33 and extending in parallel relation with the axis of the rocker shaft 20. The cylinder hole 36 is closed at the end opposite the third rocker arm 19 by a plug 37. The cylinder hole 36 consists of a pin sliding portion 38 having a diameter equal to that of the guide hole 33 and formed on the third rocker arm 19 side, a piston sliding portion 39 having a diameter smaller than that of the pin sliding portion 38 and formed adjacent to the pin sliding portion 38, and an oil pressure chamber 40 having a diameter larger than that of the piston sliding portion 39 and formed adjacent to the piston sliding portion 39. A restricting shoulder 41 facing the third rocker arm 19 side is formed between the pin sliding portion 38 and the piston sliding portion 39. The synchro pin 29 is slidable in the pin sliding portion 38, and abuts against the restricting shoulder 41, which serves to restrict the movement of the synchro pin 29 toward the second rocker arm 18 side. Under such a restricted condition, the second and third rocker arms 18 and 19 are connected with each other through the synchro pin 29.

The timing piston 30 consists of a cup-shaped cylindrical member 42 and a cylindrical member 43 slidably fitted with each other. The cup-shaped cylindrical member 42 has an open end facing the third rocker arm 19 side and is slidably fitted to the piston sliding portion 39 of hole 36. The cylindrical member 43 has a biasing flange 44 formed at one end thereof slidably fitted to the piston sliding portion 39, and is slidably fitted in the cup-shaped cylindrical member 42. A spring 45 is interposed between the bottom portion of the cup-shaped cylindrical member 42 and an internal end portion of the cylindrical member 43, and the cylindrical member 43 is biased by the spring force of the spring 45 toward the third rocker arm 19 side. Further, the cylindrical member 43 is formed with a through hole 46 at one end thereof, and therefore the internal portion of the timing piston 30 is communicated through the through hole 46, the through hole 35 of the synchro pin 29, and the air vent hole 34 at the bottom portion of the guide hole 33 to the exterior of the assembly. Accordingly, relative axial movement of the cylindrical member 43 and the cup-shaped cylindrical member 42 may be freely conducted without resistance due to any increase or decrease in air pressure in the timing piston 30.

The lengths of the cup-shaped cylindrical member 42 and the cylindrical member 43 are set in such a manner that when the bottom portion of the cup-shaped cylindrical member 42 abuts against the plug 37, and the biasing flange 44 of the cylindrical member 43 abuts against the synchro pin 29 abutting against the restricting shoulder 41, an engagement groove 47 for engaging with the trigger plate 32 is formed between the biasing flange 44 and the end of the cup-shaped cylindrical member 42. Further, the cup-shaped cylindrical member 42 is formed with an engagement groove 48 on its outer circumference for engaging with the trigger plate 32. The position of the engagement groove 48 is set in such a manner that when hydraulic pressure is applied to the oil pressure chamber 40 and the timing piston 30 urges the synchro pin 29 toward and into third rocker arm 19 to release the connection between the second and third rocker arms 18 and 19, the trigger plate 32 is permitted to be engagd with the engagement groove 48.

The second rocker arm 18 is formed with a groove 49 pivotably and slidably fitted with the trigger plate 32. The trigger plate 32 is fitted in the groove 49 and is pivotably supported on the second rocker arm 18 by a pivot pin 50 parallel to the axis of the rocker shaft 20. The pin 50 is provided with E-shaped retainer rings 51 and 52 engaged at both ends thereof.

Figure 5:
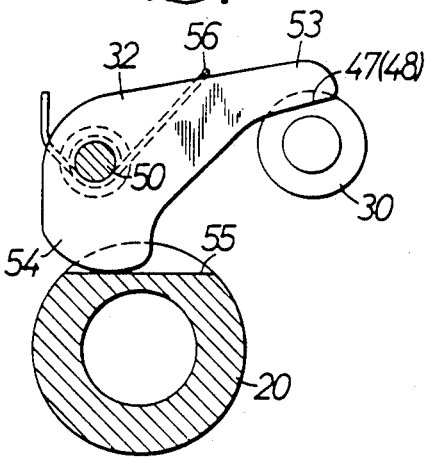
FIG. 5 is an enlarged sectional end view of the rocker arm shaft and mechanism for timing the actuation of the valve operation stopping mechanism of FIGS. 1–4.

Referring to FIG. 5, the trigger plate 32 is formed with an arm portion 53 extending from the location of the pivot pin 50 to the timing piston 30 side and an abutting portion 54 extending from the location of the pivot pin 50 to the rocker shaft 20 side. The arm portion 53 is engageable with the engagement grooves 47 and 48, and the abutting portion 54 abuts against a cam surface 55 formed by lateral groove machined in the outer circumference of the rocker shaft 20. A substantially U-shaped spring 56 is pivotably supported on both ends of the pin 50, and an intermediate portion of the spring 56 is abutted against an upper surface of the arm portion 53, while both ends of the spring 56 are abutted against a side surface of the second rocker arm 18 on the rocker shaft 20 side. Therefore, the trigger plate 32 is biased by the spring force of the spring 56 in a direction such that the arm portion 53 is urged toward the timing piston 30 side, that is, the arm portion 53 rotates clockwise about the pin 50 in FIG. 5. Further, the cam surface 55 and the abutting portion 54 are shaped in such a manner that when the second rocker arm 18 is rotated in a valve opening direction, that is, the second rocker arm 18 and the pin 50 are rotated counterclockwise about the rocker shaft 20 in FIG. 5, the trigger plate 32 is rotated counterclockwise about the pin 50 against the biasing force of the spring 56 to disengage the arm portion 53 from the engagement groove 47 or 48 of the timing piston 30.

In the operation stopping mechanism 6*a* as above described, when no hydraulic pressure is applied to the oil pressure chamber 40, the synchro pin 29 is positioned within the pin sliding portion 38 of the cylinder hole 36 by the spring force of the spring 31 to connect the second and third rocker arms 18 and 19. Accordingly, the third rocker arm 19 is rocked integrally with the second rocker arm 18 to open and close the suction valve 3*a* through the engagement arm 28.

When hydraulic pressure is applied to the oil pressure chamber 40, the cup-shaped cylindrical member 42 of the timing piston 30 is urged toward the third rocker arm 19 side but if the suction valve 3*a* is closed, the cup-shaped cylindrical member 42 is stopped by the restricting arm portion 53 of the trigger plate 32 being engaged with the engagement groove 47. However, during a valve opening operation of the suction valve 3*a*, since the restricting arm portion 53 of the trigger plate 32 is disengaged from the engagement groove 47, the cup-shaped cylindrical member 42 is permitted to operate and abuts against the biasing flange 44 of the cylindrical member 43 to urge the synchro pin 29 toward the third rocker arm 19. When the valve opening operation of the suction valve 3*a* reaches completion, the sliding resistance between the synchro pin 29 and the pin sliding portion 38 becomes zero, and accordingly the synchro pin 29 is disengaged from the pin sliding portion 38 of the cylinder hole 36 and is urged into the guide hole 33. As a result, the connection between the second and third rocker arms 18 and 19 is released, and the third rocker arm 19 maintains a valve closed condition of the suction valve 3*a* regardless of the rocking operation of the second rocker arm 18.

Figure 6:
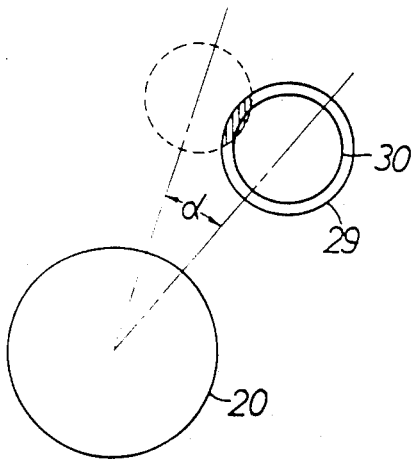
FIG. 6 is a diagrammatic view illustrating the relation between the timing piston and synchro pin of the valve operation stopping mechanism of FIGS. 1–5.

Referring to FIG. 6, the diameter of the synchro pin 29 is established in such a manner that when the second and third rocker arms 18 and 19 are under the connection released condition, the timing piston 30 is always in sliding contact with the synchro pin 29 irrespective of the rocking operation of the second rocker arm 18. In other words, the diameter of the synchro pin 29 is set in such a manner that when the second rocker arm 18 is in rocking motion about the rocker shaft 20 as a fulcrum in the range of an angle $\alpha$, and even if the timing piston 30 conducts an angular displacement from a first position where both the axis of the timing piston 30 and the synchro pin 29 are in coincidence with each other as shown by a solid line in FIG. 6 to a second position as shown by a dotted line, the timing piston 30 is in sliding contact with the synchro pin 29 in an area as shown by the oblique lines. Further, the diameter of the timing piston 30 may be established in the same manner as above to be sufficiently large to maintain the overlap during rocking of rocker arm 18.

When the second and third rocker arms 18 and 19 are intended to be connected agin, the hydraulic pressure in the oil pressure chamber 40 is released to allow the synchro pin 29 to be urged toward the second rocker arm 18 by the spring force of the spring 31. When the second rocker arm 18 is positioned to close the suction valve 3*a*, the trigger plate 32 is engaged with the engagement groove 48, and therefore operation of the timing piston 30 is restricted to hinder movement of the synchro pin 29. When the second rocker arm 18 is rotated to conduct a valve opening operation, the trigger plate 32 is disengaged from the engagement groove 48, and therefore the synchro pin 29 urges the timing piston 30 to come into sliding contact with the pin sliding portion 38 of the cylinder hole 31. Thus, the second and third rocker arms 18 and 19 are connected to each other again, and the third rocker arm 19 is rocked together with the second rocker arm 18 to open the suction valve 3*a*.

Figure 7:
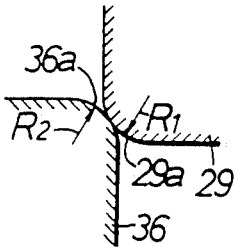
FIG. 7 is an enlarged sectional view of a portion of the end of the synchro pin and cooperating cylinder hole of the mechanism.

In order to conduct a smooth slide-fitting operation of the synchro pin 29 to the pin sliding portion 38, even if the axis of the synchro pin 29 is slightly offset from the axis of the cylinder hole 36 during reconnection operation of the second and third rocker arms 18 and 19, an opening edge 36*a* of the cylinder hole 36 and a circumferential edge 29*a* of the end portion of the synchro pin 29 are provided with a smooth curvature as shown in FIG. 7. In other words, when the second and third rocker arms 18 and 19 are under the connection released condition, the third rocker arm 19 is permitted to be rocked at a slight angle corresponding to the up-and-down movement of the end portion of the engagement arm 28 between the upper lifter 12 and the lower lifter 11, and upon reconnection operation of the second and third rocker arms 18 and 19, there is a possibility that the axis of the synchro pin 29 is slightly offset from the axis of the timing piston 30. Therefore, even in the case as above mentioned, the radius of curvature R1 of the circumferential edge 29*a* of the end portion of the synchro pin 29 and the radius of curvature R2 of the opening edge 36*a* of the cylinder hole 36 are set so that the slide-fitting operation of the synchro pin 29 to the pin sliding portion 38 may be automatically and smoothly conducted.

Next, the construction of the hydraulic pressure supply system for the operation stopping mechanism 6*a* will be decribed with reference to FIG. 3. An oil pressure source 57 comprises a hydraulic pump 58 and an accumulator 59. A plunger 61 in the cylinder 60 of the hydraulic pump 58 is reciprocatingly driven by a drive rod 62 to draw hydraulic oil from the suction valve 63 and deliver same through an outlet valve 64. The drive rod 62 is driven by a drive cam 65 integrally formed on the cam shaft 4. The plunger 61 is biased by a spring 66 so as to always abut against the drive rod 62. The accumulator 59 is connected to a delivery oil passage 67 leading from the outlet valve 64, and the delivery oil passage 67 is connected to an electromagnetic selector valve 68.

The electromagnetic selector valve 68 is selectable between a first select mode where the delivery oil passage 67 is connected to an oil passage 69 and a second select mode where the oil passage 67 is connected to an open oil passage 70. The first select mode is obtained by exciting a solenoid 71, and the second select mode is obtained by deexciting the solenoid 71.

The oil passage 69 is connected to an oil passage 72 formed in the rocker shaft 20 coaxially therewith. A communication hole 73 is formed through a side wall of the rocker shaft 20 at a location corresponding to the oil pressure chamber 40 of the second rocker arm 18, and is communicated through an oil passage 74 formed in the second rocker arm 18 to the oil pressure chamber 40. Accordingly, when the solenoid 71 is excited to actuate the electromagnetic selector valve 68 to the first select mode, hydraulic oil from the hydraulic pump 58 is supplied to the oil pressure chamber 40. On the other hand, when the solenoid 71 is deexcited to actuate the electromagnetic selector valve 68 to the second select mode, hydraulic pressure in the oil pressure chamber 40 is released.

Figure 8:
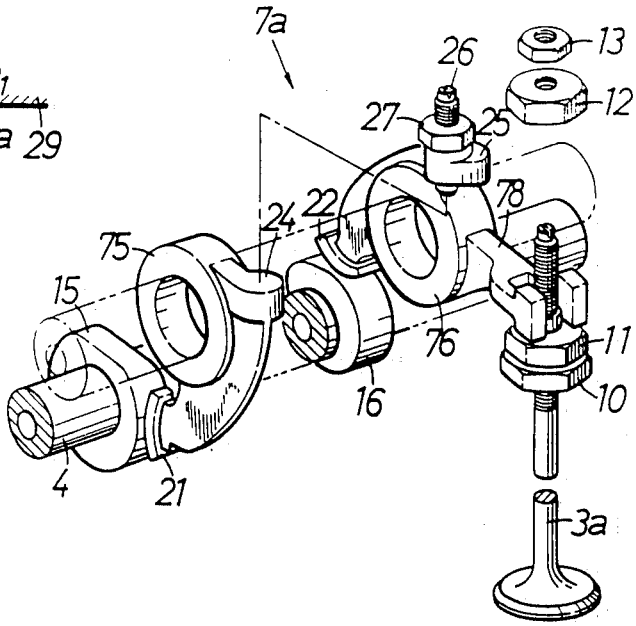
FIG. 8 is an exploded perspective view of the positive or forced valve operating mechanism of FIG. 3 but without the valve operation stopping means.

Referring next to FIG. 8, the continuous positive or forced valving mechanism 7*a* comprises a first rocker arm 75 rocking in contact with the valve closing cam 15 and a second rocker arm 76 rocking in contact with the valve opening cam 16. The second rocker arm is interlocked with the first rocker arm 75 in the same manner as previously described by a tappet screw 26 engaging the abutment 24. The second rocker arm 76 is integrally formed with an engagement arm 78 engaging the suction valve 3*a*. Namely, since the engagement arm 78 of the continuously forced valving mechanism 7*a* is integrally constructed with the second rocker arm 76, the engagement arm 78 is caused to conduct an up-and-down motion at all times according to the rocking motion of the first and second rocker arms 75 and 76, and therefore the suction valve 3*a* is always opened and closed irrespective of the magnitude of the engine running load during rotary operation of the cam shaft 4, that is, during operation of the engine. In FIG. 8, corresponding parts of the forced valving mechanism 5*a* that are the same as previously mentioned are identified by identical reference numerals.

In operation, when the internal combustion engine E is operated under high load, no hydraulic pressure is applied to the oil pressure chamber 40 of the operation stopping mechanisms 6*a* to 6*c*, and accordingly the second and third rocker arms 18 and 19 of the forced valving mechanisms 5*a* to 5*c* are connected with each other through the synchro pins 29. As a result, in the first and fourth cylinders, the third rocker arm 19 is rocked by the first rocker arm 17 rocking in contact with the valve closing cam 15 and the second rocker arm 18 rocking in contact with the valve opening cam 16 while being interlocked with the first rocker arm 17, thereby forcibly opening and closing each of the valves 3*a* to 3*c*. On the other hand, in the second and third cylinders, each of the valves 3*a* to 3*c* is forcibly opened and closed by the first rocker arm 75 rocking in contact with the valve closing cam 15 and the second rocker arm 76 rocking in contact with the valve opening cam 16 while being interlocked with the first rocker arm 75. In this manner, each of the valves 3*a* to 3*c* is forcibly driven to follow the cam profile of the valve closing cam 15 and the valve opening cam 16 which are designed to an ideal shape, thereby improving efficiency of suction and exhaust. Further, the spring force of the spring 14 is selected to be a small value only as required to maintain the valve closed when it is not being operated, whereby the spring force does not significantly interfere with the operation of the valves 3*a* to 3*c*. In other words, the resistive force of the spring 14 is small during the valve opening operation, whereby the valve operating load may be reduced and therefore fuel consumption also may be reduced.

When the internal combustion engine E is operating under low load, the electromagnetic selector valve 68 is excited to supply hydraulic pressure from the oil passages 69 and 72 through the communication port 73 and oil passage 74 to the oil pressure chambers 40 of the operation stopping mechanisms 6*a* to 6*c*. As a result, each of the timing pistons 30 is urged toward each of the third rocker arms 19, and each of the synchro pins 29 is inserted into the guide hole 33 against the spring force of the spring 31. At this time, when the second rocker arm 18 is positioned to close the suction valve, the trigger plate 32 is in engagement with the engagement groove 47 and therefore the movement of the timing piston 30 is restricted. On the other hand, when the second rocker arm 18 is operated to open the suction valve, the trigger plate 32 is disengaged from the engagement groove 47 to permit movement of the timing piston 30. However, while the second and third rocker arms 18 and 19 are in moving operation, the synchro pin 29 is prevented from being disengaged from the pin sliding portion 38 by the forces being transmitted from arm 18 to arm 19 through the pin but the groove 47 is closed by the movement of cup-shaped member 42 and thereafter when the arms 18 and 19 come to rest the pin 29 is smoothly inserted into the guide hole 33 without being hindered by the cylinder hole 36.

The connection between the second and third rocker arms 18 and 19 is released by urging the synchro pin 29 backwardly into the guide hole 33, and the third rocker arm 19 retains its valve closed condition with the aid of the spring 14 independently of the operation of the second rocker arm 18.

As previously described with reference to FIG. 6, the diameters of the synchro pin 29 and timing piston 30 are sufficiently large that the timing piston 30 is always in sliding contact with the synchro pin 29 irrespective of the rocking motion of the second rocker arm 18, thereby preventing any posibility of the synchro pin 29 being projected any further toward the second rocker arm 18 side. Further, as the engagement groove 48 of the cup-shaped cylindrical member 42 of the timing piston 30 is positioned adjacent the trigger plate 32, the trigger plate 32 comes into engagement with the engagement groove 48 upon the valve closing operation of the second rocker arm 18.

As is above described, the operation of each of the valves 3*a* to 3*c* of the first and fourth cylinders is stopped during low load running operation of the internal combustion engine E, and each of the valves 3*a* to 3*c* of the second and third cylinders is forcibly operated by the continuous forced valving mechanisms 7*a* to 7*c* at all times. Accordingly, fuel consumption during low load running operation may be largely reduced.

When the operation of the internal combustion engine E is returned from low load running to high load running, the solenoid 71 of the electromagnetic selector valve 68 is deexcited to relieve the hydraulic pressure in each of the oil pressure chambers 40 of the first and fourth cylinders. In response to this, the synchro pin 29 in each of the operation stopping mechanisms 6*a* to 6*c* is biased by the spring force of the spring 31 toward the timing piston 30 and the pin 29 becomes slidably fitted into the pin sliding portion 38 of the cylinder hole 36. However, when the second rocker arm 18 is in the valve closing position, the trigger plate 32 is in engagement with the engagement groove 48, and therefore movement of the piston 30 and the synchro pin 29 are prevented. When the second rocker arm 18 causes the valve opening operation, the trigger plate 32 is disengaged from the engagement groove 48, and therefore the movements of the timing piston 30 and the synchro pin 29 are permitted. Accordingly, in the same manner as of the connection released operation of the second and third rocker arms 18 and 19, the synchro pin 29 is smoothly fitted to the pin sliding portion 38 of the cylinder hole 36 when the second and third rocker arms 18 and 19 are at rest.

Furthermore, as the radius of curvature R1 of the circumferential edge 29*a* of the end portion of the synchro pin 29 and the radius of curvature R2 of the opening edge 36*a* of the cylinder hole 36 are set in such a manner as to permit automatic and smooth fitting of the synchro pin 29 to the pin sliding portion 38, the synchro pin 29 may be smoothly fitted to the pin sliding portion 38 of the cylinder hole 36 even if the axis of the synchro pin 29 is slightly offset from the axis of the cylinder hole 36.

Both the second and third rocker arms 18 and 19 are connected to each other again by the slide fitting operation of the synchro pin 29 to the pin sliding portion 38, and in the first and fourth cylinders, the valve opening and closing operation of each of the valves 3*a* and 3*c* is restricted by the forced valving mechanisms 5*a* to 5*c*. At this stage, in the second and third cylinders, the valve opening and closing operation of each of the valves 3*a* to 3*c* is continued by the continuously forced valving mechanisms 7*a* to 7*c*. Consequently, each of the valves 3*a* to 3*c* of all the cylinders is forcibly operated to establish high loan running operation of the internal combustion engine E.

Figure 9:
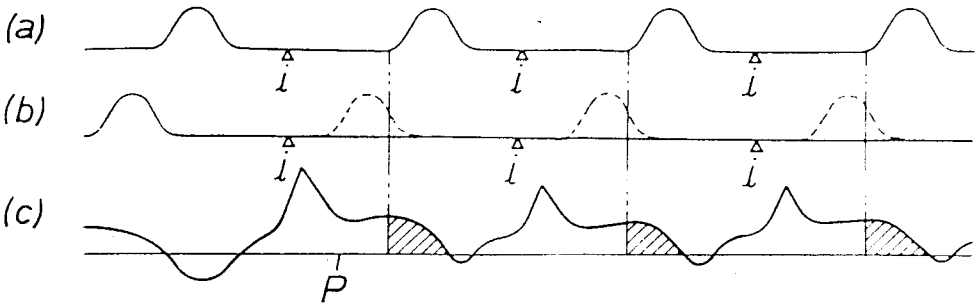
FIGS. 9 and 10 are graphs illustrating the pressure changes in the cylinder in a sequence of stopping the operation of the intake and exhaust valves.

Next, the operational sequence of the operation stopping mechanisms 6*a* and 6*b* corresponding to the section valve 3*a* and the exhaust valve 3*b*, respectively, that is, sequence of operation and unoperation of the suction valve 3*a* and the exhaust valve 3*b* will be considered below with refeence to FIG. 9. In the event that the exhaust valve 3*b* oepration is stopped earlier than the suction valve 3*a*, a blow-back phenomenon to the suction system is generated as shown in FIG. 9. Lines (a), (b) and (c) of FIG. 9 show the lift of the suction valve 3*a*, the lift of the exhaust valve 3*b* and the pressure in the cylinder, respectively. Reference numerals (i) and P designate ignition timing and pressure in the cylinder, respectively. As will be apparent from FIG. 9, when the exhaust valve 3*b* is stopped to operate first, that is, it is closed first, the suction valve 3*a* is opened, and therefore the blow-back phenomenon to the suction system is generated in the area as shown by oblique lines. Such a phenomenon is similarly generated when the suction valve 3*a* and the exhaust vale 3*b* are stopped, and then the suction valve 3*a* is started to operate earlier than the exhaust valve 36. Such a blow-back phenomenon to the suction system disadvantageously causes blocking of a carburetor, noise and engine stall, etc.

Figure 10:
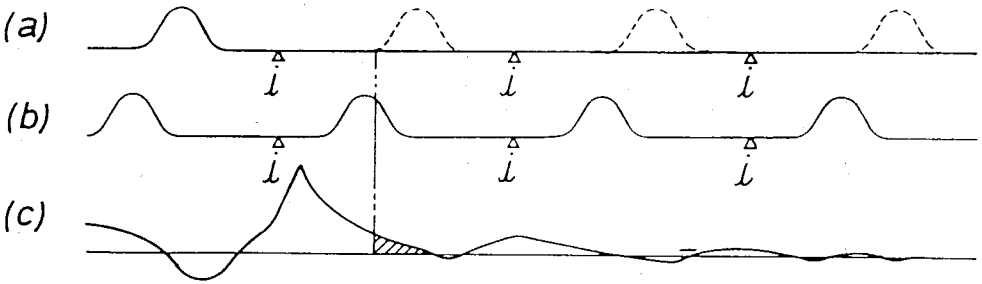

However, when the suction valve 3*a* operation is stopped earlier than the exhaust valve 3*b*, or when the exhaust valve 3*b* operation is started earlier than or simultaneously with the suction valve 3*a*, the result is shown in FIG. 10, lines (a), (b) and (c). Namely, when the exhaust valve 3*b* is opened as shown in line (b) and the suction valve 3*a* is closed as shown in line (a), the blow-back phenomenon is not generated irrespective of increased pressure in the cylinder as shown by the oblique hatching below the line (c).

Accordingly, the following preferred embodiment is intended to prevent the blow-back phenomenon by stopping the suction valve 3*a* earlier than the exhaust valve 3*b* and then starting the suction valve 3*a* simultaneously with the exhaust valve 3*b*.

Figure 11:
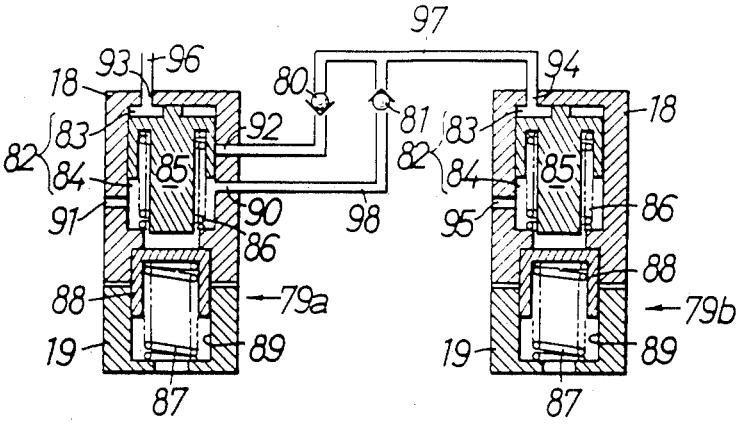
FIG. 11 is a diagrammatic view of a modified embodiment of the hydraulic system of the present invention.

Referring to FIG. 11 which shows the second preferred embodiment of a portion of the present invention, an operation stopping mechanism 79*a* for the suction valve 3*a* is connected through a pair of check valves 80 and 81 to an operation stopping mechanism 79*b* for the exhaust valve 3*b*. Oil pressure chambers 82 of both the operation stopping mechanisms 79*a* and 79*b* are partitioned by timing pistons 85 to subsequent chambers 83 and antecedent chambers 84. The timing pistons 85 are movable between a first operational position where the pistons 85 are moved by springs 86 under no hydraulic pressure in the subsequent chambers 83 and a second operation stopping position where the pistons 85 urge synchro pins 88 into guide holes 89 against a spring force of springs 86 and 87 upon application of hydraulic pressure to the subsequent chambers 83. There are formed, in the second rocker arm 18 on the suction valve 3*a* side (left side of FIG. 11), oil passages 90 and 91 communicated with the antecedent chamber 84 when the timing piston 85 is in the first operational position, which are closed by the timing piston 85 when the timing piston 85 is in the second operation stopping position, an oil passage 92 closed by the timing piston 85 when the timing piston 85 is in the first operational position, which communicates with the subsequent chamber 83 when the timing piston 85 is in the second operation stopping position, and an oil passage 93 continuously communicating with the subsequent chamber 83. Further, there are formed in the second rocker arm 18 on the exhaust valve 3*b* side (right side of FIG. 11), an oil passage 94 continuously communicating with the subsequent chamber 83 and an oil passage 95 communicating with the antecedent chamber 84 when the timing piston 85 is in the first operational position, which is closed when the timing piston 85 is in the second operation stopping position.

An oil passage 96 for supplying hydraulic pressure from the electromagnetic selector valve (See FIG. 3) is connected to the oil passage 93. The oil passages 92 and 94 are connected through an oil passage 97, and a check valve 80 for permitting communication of hydraulic oil only from the oil passage 92 side to the oil passage 94 side is provided in the oil passage 97. An oil passage 98 branched from the oil passage 97 at a position between the check valve 80 and the oil passage 94 on the exhaust valve 3*b* side is connected to the oil passage 90 on the suction valve 3*a* side. A check valve 81 permitting communication of hydraulic oil only from the oil passage 94 to the oil passage 90 is provided in the oil passage 98. The oil passage 91 on the suction valve 3*a* side and the oil passage 95 on the exhaust valve 3*b* side are opened to an oil pan (not shown).

In operation, when the suction valve 3*a* and the exhaust valve 3*b* operations are stopped, hydraulic pressure is supplied from the oil passage 96 through the oil passage 93 to the subsequent chamber 83 of the oil pressure chamber 82 in the operation stopping mechanism 79*a*. The timing piston 85 of the operation stopping mechanism 79*a* is operated to urge the synchro pin 88 into the guide hole 89 and release connection between the second and third rocker arms 18 and 19, thus stopping the operation of the suction valve 3*a*. By such a movement of the timing piston 85 to the operation stopping position, the oil passage 92 is brought into communication with the subsequent chamber 83 to supply hydraulic pressure through the check valve 80 to the subsequent chamber 83 of the operation stopping mechanism 79*b*. As a result, the timing piston 85 in the operation stopping mechanism 79*b* is operated to urge the synchro pin 88 into the guide hole 89, thus stopping the operation of the exhaust valve 3*b*. In this manner, for stoppage of the valve operation, only after the suction valve 3*a* operation is stopped is the operation of the exhaust valve 3*b* stopped.

Next, when a valve operation is restarted, the hydraulic pressure is relieved from the oil passage 96. As a result, the timing piston 85 of the operation stopping mechanism 79*a* is retracted by the spring force of the spring 86 and 87, and the second and third rocker arms 18 and 19 are brought into connection with each other by the synchro pin 88. On the other hand, simultaneously as the oil passage 90 is communicated with the antecedent chamber 84, the hydraulic pressure in the subsequent chamber 83 of the operation stopping mechanism 79*b* is relieved through the check valve 81. Accordingly, both the timing pistons 85 of the operation stopping mechanisms 79*a* and 79*b* are simultaneously retracted to connect the second and third rocker arms 18 and 19.

Although the previous description is related to a multicylinder internal combustion engine of such a type that the valves are forcibly opened and closed by the first and second rocker arms 17 and 18 adapted to contact with the valve closing cam 15 and the valve opening cam 16, respectively, the present invention also is applicable to the type multi-cylinder internal combustion engine that includes a single cam arranged with respect to each valve, wherein rocker arms are rocked according to rotary motion of that cam.

What is claimed:

1. In a valve operating mechanism for multi-cylinder internal combustion engine including a cam shaft with a plurality of cams formed integrally with said cam shaft at positions corresponding to suction valves and exhaust valves for each cylinder, a valve operation stopping device comprising a drive rocker arm engaging one of said cams, a driven rocker arm engaging one of either the suction valves or the exhaust valves, said drive rocker arm and said driven rocker arm being pivotably supported on the same axis to permit relative angular displacement, a synchro pin slidably mounted in said driven rocker arm to engage with said drive rocker arm to prevent said relative axial displacement, means biasing said synchro pin toward engagement with said drive rocker arm, and a timing piston provided in said drive rocker arm at a position corresponding to said synchro pin and acting to urge said synchro pin toward said driven rocker arm by hydraulic pressure to release connection between said drive rocker arm and said driven rocker arm.

2. The valve operation stopping device for the multi-cylinder internal combustion engine as defined in claim 1, wherein said drive rocker arm is provided with a trigger plate for restricting movement of said timing piston according to an angular position of said drive rocker arm.

3. The valve operation stopping device for the multi-cylinder internal combustion engine as defined in claim 1, wherein the diameters of said timing piston and said synchro pin are such as to retain abutment engagement of said timing piston and said synchro pin irrespective of said relative angular displacement of said drive rocker arm and said driven rocker arm.

4. The valve operation stopping device of claim 1 wherein another rocker arm is pivotally supported on the same axis as the drive and driven rocker arms and engages another of said cams, means adjustably connecting said another rocker arm and said drive rocker arm to pivot together with one cam and arm causing valve opening and the other cam and arm causing valve closing.

5. The valve operation stopping device of claim 1 wherein said synchro pin is mounted to slide on an axis parallel with and spaced from the pivotal axis of said rocker arms.

6. The valve operation stopping device of claim 5 wherein said timing piston is mounted to slide on the same axis as said synchro pin when said rocker arms are angularly positioned for interengagement by said synchro pin.

7. The valve operation stopping device of claim 1 wherein said timing piston is comprised of two axially slidable members, a spring means biasing said two members apart and said hydraulic pressure acting only on one said member with the other said member comprising the portion of said timing piston that engages said synchro pin.

8. The valve operation stoppping device of claim 7 wherein said two members form a groove between portions thereof in their axially extended relationship which groove is closed in their axially collapsed relationship, and a trigger plate mounted on said drive rocker arm and movable to a position to engage said groove between said two members to prevent the said release between said arms.

9. The valve operation stopping device of claim 8 wherein means are provided for engaging said trigger plate during pivoting of said drive rocker arm for moving said trigger plate out of engagement with said groove.

10. The valve operation stopping device of claim 7 wherein said one member is provided with circumferential groove means, and a trigger plate is movably mounted on said drive rocker arm for engaging said circumferential groove means for selectively preventing movement of said timing piston one member.

11. The valve operating mechanism of claim 1 wherein first and second valve operation stopping device are provided for separately operating the suction and exhaust valves, respectively, of selected cylinder, and means are provided for controlling the order of supply and release of hydraulic pressure to the timing pistons of said respective devices for always causing valve operations stopping of the suction valve before the exhaust valve.

12. The valve operating mechanism of claim 11 wherein said controlling means includes means for causing valve operation restarting of said exhaust and suction valves to occur substantially simultaneously.

13. The valve operating mechanism of claim 11 wherein passages connect the said timing pistons of said first and second valve operation stopping devices, check valves provided in said passages, and said passages arrange to allow pressurized hydraulic fluid to flow to said second timing piston only after full movement of said first timing piston to the suction valve operation stopping position.

14. The valve operation stopping device for the multi-cylinder internal combustion engine as defined in claim 1, wherein said drive rocker arm is provided with a trigger plate for restricting movement of said timing piston according to an angular position of said drive rocker arm.

15. The valve operation stopping device for the multi-cylinder internal combustion engine as defined in claim 1, wherein the diameters of said timing piston and said synchro pin are related in such a manner as to retain abutment of said timing piston and said synchro pin irrespective of relative angular displacement of said drive rocker arm and said driven rocker arm.

16. In a multi-cylinder internal combustion engine including a cam shaft adapted to be rotated synchronously with rotation of the engine crankshaft, a plurality of cams formed integrally with said cam shaft at positions corresponding to suction valves and exhaust valves for each cylinder, a rocker shaft arranged in parallel relation with said cam shaft, and a plurality of rocker arms pivotably supported to said rocker shaft and adapted to be rocked in contact with said cams for each cylinder and operate said suction and exhaust valves, a valve operation stopping device comprising a separate drive rocker arm engaging the suction and exhaust cams associated with a specific cylinder, a separate driven rocker arm engaging said suction valve and said exhaust valve of that cylinder, each said drive rocker arm and said driven rocker arm being pivotably supported on said rocker shaft to allow relative angular displacement, a synchro pin provided in each said driven rocker arm to slidably engage with the associated said driven rocker arm, each said synchro pin being axially slidable and biased by a spring in a direction to engage said drive rocker arm, and a timing piston provided in said drive rocker arm at a position corresponding to said synchro pin and acting to urge said synchro pin toward said driven rocker arm by hydraulic pressure to release connection between said drive rocker arm and said driven rocker arm.

17. In a valve operating mechanism for a multi-cylinder internal combustion engine having a cam shaft with cams for actuating each of the exhaust and suction valves, at least one cylinder having exhaust and suction valve operation stopping devices, comprising for each valve, a drive rocker arm and a driven rocker arm mounted for pivotal rocking on the same axis together for valve operation and separately for valve operation stopping, said drive rocker arm engaging a said cam and said driven rocker arm engaging a said valve, and means for selective connecting and disconnecting said drive rocker arm and driven rocker arm including a timing piston slidably mounted on one rocker arm and a synchro pin slidably mounted on the other rocker arm in juxtaposed positions for interengagement and sliding on an axis parallel to said axis of pivotal rocking of said rocker arms, said synchro pin selectively engageable with both arms for causing simultaneous pivoting of said arms, and means for selectively causing sliding movement of said timing piston relation to the angular positions of said rocker arms for inturn causing engagement and disengagement of said synchro pin between the two rocker arms.

18. The valve operating mechanism of claim 17 wherein said means for causing timing piston movement includes a hydraulic fluid supply means operable in response to engine load conditions.

19. The valve operation mechanism of claim 17 wherein said means for selectively causing movement of said timing piston includes trigger plate means for mechanically restraining said timing piston in selected positions during non-movement of said drive rocker arm corresponding to the closed position of the valve.

* * * * *

UNITED STATES PATENT AND TRADEMARK OFFICE

CERTIFICATE OF CORRECTION

PATENT NO. : 4,576,128

DATED : March 18, 1986

INVENTOR(S) : Kenichi Nagahiro

It is certified that error appears in the above-identified patent and that said Letters Patent is hereby corrected as shown below:

Please correct the name of the inventor on the first page at the top from "Kenichi" to --Nagahiro--

Signed and Sealed this

*Eighth* Day of *July 1986*

[SEAL]

*Attest:*

DONALD J. QUIGG

*Attesting Officer*

*Commissioner of Patents and Trademarks*